US008851576B2

(12) United States Patent
MacNeil

(10) Patent No.: US 8,851,576 B2
(45) Date of Patent: Oct. 7, 2014

(54) HYDRO-DEMOLITION FACET CUTTER AND METHOD OF USE

(75) Inventor: Gerard J. MacNeil, Surrey (CA)

(73) Assignee: Mac & Mac Hydrodemolition Inc., Surrey (CA)

( * ) Notice: Subject to any disclaimer, the term of this patent is extended or adjusted under 35 U.S.C. 154(b) by 987 days.

(21) Appl. No.: 12/705,907

(22) Filed: Feb. 15, 2010

(65) Prior Publication Data

US 2011/0056355 A1 Mar. 10, 2011

Related U.S. Application Data

(60) Provisional application No. 61/240,087, filed on Sep. 4, 2009.

(51) Int. Cl.

| | |
|---|---|
| ***E21C 25/60*** | (2006.01) |
| ***B26F 3/00*** | (2006.01) |
| ***E04G 23/08*** | (2006.01) |

(52) U.S. Cl.

CPC ..... *B26F 3/004* (2013.01); *E04G 23/08* (2013.01)

USPC ..... 299/16

(58) Field of Classification Search

USPC ..... 299/16, 17; 175/67, 424

See application file for complete search history.

(56) References Cited

U.S. PATENT DOCUMENTS

| | | | | |
|---|---|---|---|---|
| 4,081,200 | A | 3/1978 | Cheung | |
| 4,854,770 | A | 8/1989 | Puchala | |
| 6,179,519 | B1 | 1/2001 | Hilmersson | |
| 7,644,782 | B1 * | 1/2010 | Coogan et al. | 173/1 |
| 2005/0077775 | A1 | 4/2005 | Nakakuro | |
| 2006/0087168 | A1 * | 4/2006 | MacNeil et al. | 299/17 |
| 2008/0041015 | A1 | 2/2008 | MacNeil | |

FOREIGN PATENT DOCUMENTS

JP 2005096001 A * 4/2005

* cited by examiner

*Primary Examiner* — Sunil Singh

(57) ABSTRACT

Disclosed herein is a facet cutter used with hydro-demolition equipment in cutting openings in structural surfaces. The facet cutter includes a nozzle head with one or more nozzles. The nozzle head can be placed adjacent a side of the opening where the facet is to be cut. The nozzle head is oriented so that the axes of the nozzles are substantially perpendicular to the desire plane of the face of the facet. High-pressure fluid is applied to the nozzle and the nozzle head is moved over the plane of the facet, thereby cutting the facet. Various axial and rectilinear motions of the nozzle head may be effectuated by various drivers and rotators, at least some of which are controlled remotely by a remote control device.

9 Claims, 6 Drawing Sheets

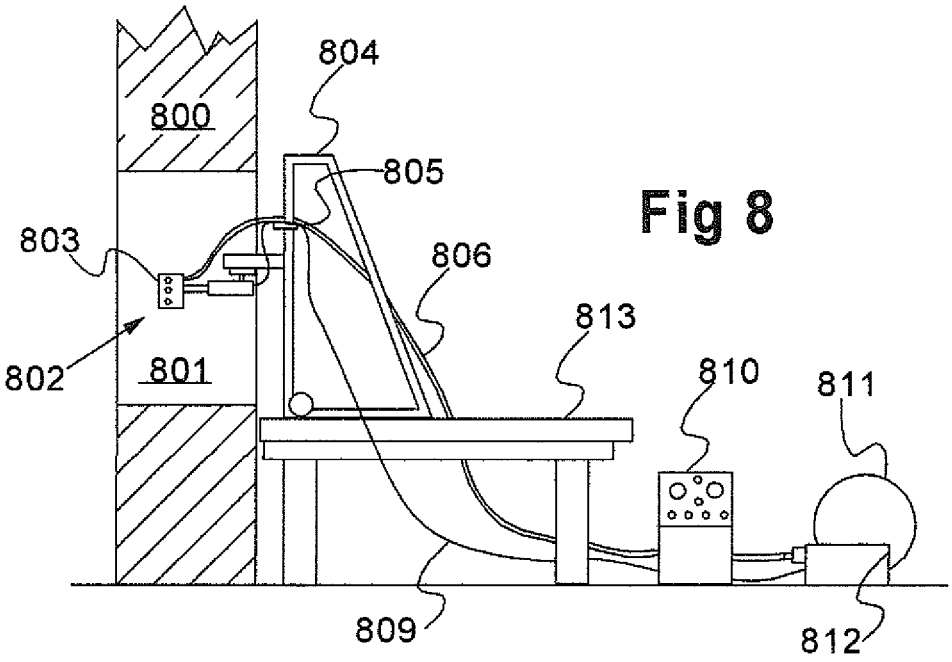
Fig 8
Fig 9
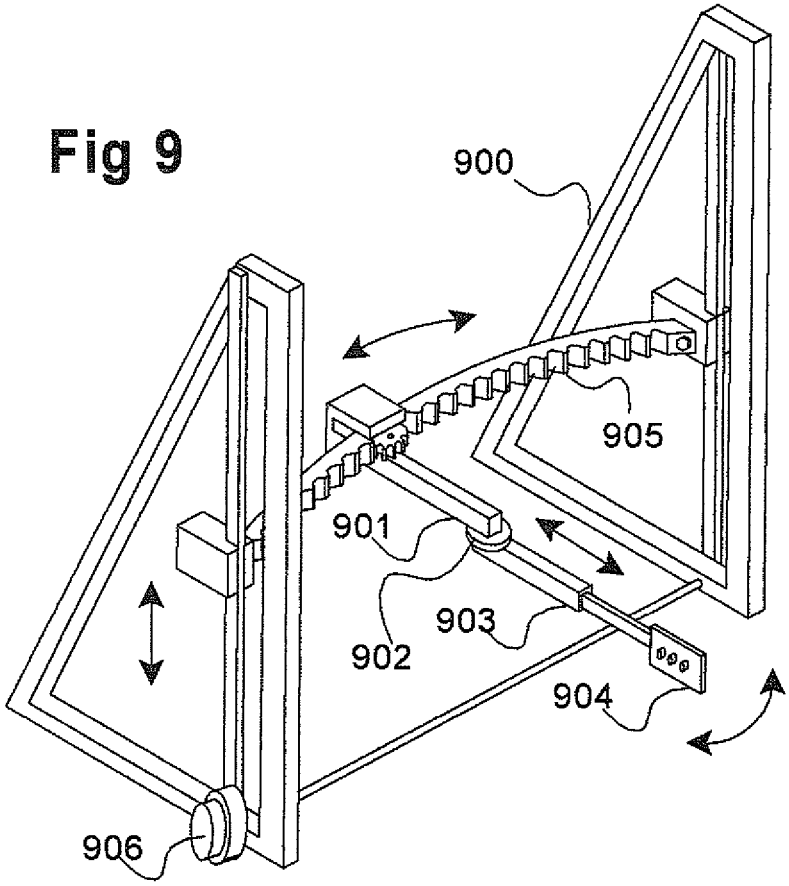

HYDRO-DEMOLITION FACET CUTTER AND METHOD OF USE

CROSS-REFERENCE TO RELATED APPLICATIONS

The present application claims priority from U.S. Provisional Patent Application 61/240,087, filed by Gerard MacNeil, David MacNeil, Gordon MacNel, and Vernon Bose on Sep. 4, 2009, incorporated herein in its entirety by reference.

BACKGROUND OF THE INVENTION

1. Field of the Invention

The field of the invention is hydro-demolition devices and methods for cuffing openings into structural surfaces.

2. Related Art

Hydraulic demolition—or hydro-demolition—is a well known art practiced by forcing an erosive material, generally a liquid such as water, through nozzles at sufficiently high pressure to produce a jet stream that disintegrates the constituent building material, normally concrete, of which buildings and structures are made.

"Structure" and "structural" are used herein to refer to any building, reactor, dam, tower, bridge, roadway, paved surface, or other entity having at least one surface that can be disintegrated by hydro-demolition techniques.

The term "structural surface" as used herein includes vertical walls, angled walls, curved walls, horizontal floors and decks, and any type of structural surface regardless of orientation or function that is amenable to having an opening cut therein by the apparatus and method disclosed below.

The terms "cut," "cutting," and "cutter," etc. as used herein refer to the use of hydro-demolition technology to remove structural material, often concrete, from a structural surface.

The term "opening" is used herein to refer to a hole that is cut into a structural surface, including a hole that does not completely penetrate the surface. The term "sides" when used without a modifier refers to the interior surfaces of such an opening, including the top, bottom, and lateral sides of the interior of the opening. The term "facet" is used to evoke the analogy of the angled, planar surface of a cut gem. "Facet" is used herein to refer to generally planar areas, angled with respect to each other and/or to unfaceted areas, cut into the sides of an opening by the invention as disclosed below. "Facet-cutter," "hydro-demolition facet-cutter," and "facet-cutting apparatus" are used interchangeably herein to refer to a hydro-demolition apparatus that can be used to cut facets in the sides of an opening, as set forth in this disclosure.

Hydro-demolition technology is often employed to cut openings in walls and other surfaces, and a number of hydro-demolition machines and techniques have been developed for these purposes. For instance, in the field of nuclear reactors it is periodically necessary to remove large pieces of equipment such as generators from the interior of the reactor for maintenance or replacement. In order to do this, it is often more economical to cut an opening in the wall of the reactor and remove the equipment through the opening rather than disassemble the equipment and take it out piece by piece through the back door, so to speak. Because hundreds of nuclear reactors are approaching or have exceeded their expected life spans, there is an increasing demand on technology that provides access to the interior of reactors. Given the thickness and structural complexity of reactor walls and given the distance above the ground the openings have to be cut, these demands represent formidable challenges.

In many cases the opening required is simply a square hole with four flat interior sides that are normal to each other or facing each other. Such simple openings can be cut with standard hydro-demolition nozzle assemblies where the nozzles are held in a fixed orientation approximately normal to the work-face. But often the opening that is required is much more complex than what can be produced by the standard nozzle assemblies. For instance, depending on the dimensions and profile of the equipment being removed from the interior of a reactor, in order to get the equipment through the wall, the sides of the opening may require multiple facets that form complex angles with each other. Complicating this problem is the fact that such complex openings are often cut into walls that are 3 feet or more thick. Thus, the nozzle head must be able to move deeper and deeper into the opening whilst maintaining the required angle of the facet.

With currently existing hydro-demolition equipment, in order to cut such facets it is necessary to either custom build facet cutters to match the facet to be cut, or else disassemble and re-assemble the standard hydro-demolition cutters to produce each facet. This adds to the cost and complexity of a job. With respect to nuclear reactors, millions of dollars per day may be lost while the reactor is down; consequently, each hour that can be saved during the cutting process has a very substantial financial impact.

Upon reading this disclosure, it will be appreciated that the invention is most precisely disclosed, defined, and claimed with reference to the types of motions and/or orientations of the various elements rather than the elements themselves. It will also be appreciated that the novel arrangement and combination of known elements disclosed herein results in both benefits and functions previously unknown in the art.

As used herein the term "axial" refers to movement about or around an axis, and does not include movement along an axis. The term "rotator" is used to mean a device or mechanism that produces axial movement of an element or component-group. The term "rectilinear" is used to denote linear movement, generally the movement of one element along or parallel to the linear axis of another element. The term "driver" is used to mean a device or mechanism that produces rectilinear movement of an element or component-group. The terms "rotator" and "driver" include the necessary drive components, if any, such as belts, chains, worm gears and the like. Such drive components are well known and one of skill in the art will immediately know how to employ them in the rotators and drivers disclosed herein without undue experimentation. The terms "rotator" and "driver" also include the necessary energy sources such as electric motors and hydraulic pumps and motors required to produce the movement, as will also be well understood by those of skill in the art. The term "remotely," as in "to remotely control," means that a driver or rotator is controlled from a distance by manipulating the controls of a control device.

BRIEF SUMMARY OF THE INVENTION

The present invention relates to a novel facet-cutting apparatus that represents an improvement in hydro-demolition technology by virtue of allowing a nozzle head to be precisely positioned and moved in order to cut a plurality of faceted openings in surfaces. The position of the nozzle head is controlled by adjusting a plurality of axial and rectilinear movements of various elements in order to precisely cut the desired facet or facets in the sides, top, and/or bottom of the opening. These axial and rectilinear movements may be controlled remotely by a control device.

The collection of the elements of the invention into component-groups as described below is arbitrary and is done to facilitate comprehension of the invention and not to limit the scope of the invention. Whilst the invention is disclosed herein with respect to an embodiment used to produce openings in vertical walls, upon reading and understanding this disclosure, one of skill in the art of hydro-demolition will be able to adapt the invention for use with virtually any type of surface, including horizontal surfaces and surfaces that are oriented intermediate between vertical and horizontal.

The primary component-groups of the facet-cutter are: 1) a nozzle head with at least one nozzle; 2) an arm assembly; 3) a yaw assembly; and, 4) a support member. Briefly, these component-groups are related as follows.

The facet-cutter comprises a nozzle head that includes at least one nozzle and the structure that holds the nozzle, such as a case or plate. The nozzle may be optionally rotatable about a nozzle rotation axis by virtue of a nozzle rotator. Where only one nozzle is present, that nozzle itself and its rotator, if any, may constitute the nozzle head.

The arm assembly includes an elongate arm and the nozzle head is attached to the distal end of the arm. The terms "distal" and "proximal" are relative to a support frame or carrier to which the facet cutter is attached. The term "proximal" refers to a component, position, or movement near or toward the frame, and the term "distal" refers to a component, position, or movement distant from or away from the frame, as will be made clear in the description below.

The nozzle head optionally may be rotatable about an axis that is coincident with or parallel to a longitudinal axis of the arm. This rotation is referred to herein as "roll" or "rolling" in analogy with the rotation of an aircraft about its longitudinal axis. The nozzle head may be rectilinearly movable along, or parallel to, the longitudinal axis of the arm so that the nozzle head is extended and retracted along and/or by the arm. The arm assembly may include rotators and drivers to effectuate the axial and rectilinear movements of the nozzle head.

The arm assembly is rotatably connected to the support member by means of a yaw device and mechanism, referred to here as a "yaw assembly." The term "yaw" is used herein in analogy with rotation of an aircraft about a vertical axis through the aircraft. A yaw rotator is provided for yawing the arm assembly and nozzle head about a yaw axis as a unit, which yaw axis is perpendicular to the longitudinal axes of the arm and the support member. Generally, this yawing is in a plane that is perpendicular to the structural surface. For instance, when working on a vertical wall, this yawing will usually, but not always, be in a horizontal plane.

The connection of the yaw assembly to the support member is, optionally, in a manner and by a mechanism that permits the yaw assembly to move rectilinearly along, or parallel to, the longitudinal axis of the support member.

The support member may form a part of or be connected to a carrier or frame. The carrier or frame is not considered a part of the facet cutting assembly of the invention but, rather, holds the facet cutting assembly in position adjacent the surface into which the opening is being cut. In the embodiment described below we focus on the use of a fixed frame, which is our preferred embodiment. However, a 'cherry-picker' or other lift device can be easily adapted to serve as the carrier for the invention, as will be apparent to those of skill in the art. What is essential, of course, is that the carrier or frame be able to lift and hold the facet cutter in position adjacent the surface into which the facet is being cut. Any carrier or frame that is capable of operation within those parameters may be adequate and within the scope of the disclosure even if it is neither preferred nor optimal.

BRIEF DESCRIPTION OF THE SEVERAL VIEWS OF THE DRAWINGS

In the drawings identical reference numbers are employed to identify identical or analogous elements. The sizes and relative positions of the elements in the drawings are not necessarily to scale. Identical elements of a plurality are given the same reference numeral and, generally, only one of such elements is labeled.

FIG. 8 is a side elevation of the invention being used to cut facets in the side of an opening.

FIG. 9 is a perspective view of the facet cutter mounted on the lift-bar of a frame.

DETAILED DESCRIPTION OF THE INVENTION

1. Elements and Component-Groups

Figure 1:
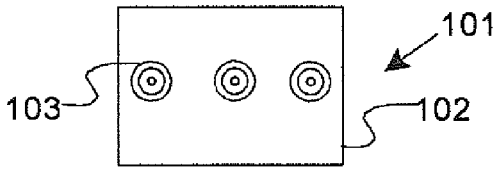
FIG. 1 is a front elevation of an exemplary nozzle head component of the invention.
Figure 2:
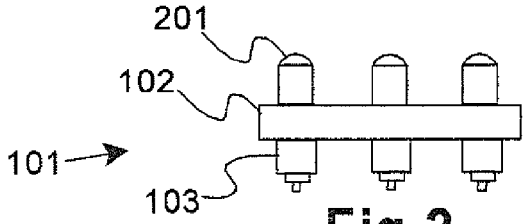
FIG. 2 is a side elevation of the exemplary nozzle head of FIG. 1.

FIG. 1 and FIG. 2 show two views of a nozzle head 101 that can be employed by this invention. The nozzle head comprises one or more nozzles, a nozzle plate or similar structure that holds the nozzles, and, optionally, one or more nozzle rotators. The embodiment shown in FIG. 1 has three nozzles, one of which is designated 103. The nozzles are mounted on nozzle plate 102. The invention does not depend upon or specify any particular number or configuration of nozzles. There may be a plurality of nozzles arranged in rows, rectangles, circles, or other geometric patterns, or there may be a single nozzle.

High-pressure hoses connect the nozzles to a source of high pressure fluid, normally water. The details of how the nozzles are connected to the source of high pressure fluid need not be specified here as such mechanisms are well known in the art and may vary according to the requirements of each job. Our preference is to connect each nozzle separately to its own high pressure pump/tank assembly; however, a manifold may be employed to distribute the fluid from a single source to all of the nozzles. In order to enhance the clarity of the drawings, neither the high-pressure fluid hoses nor hydraulic hoses used to drive the various rotator and driver elements are included in any of the drawings except FIG. 8.

FIG. 2 shows a side elevation of the same nozzle head 101 shown in FIG. 1. Nozzle 103 and nozzle plate 102 are shown. A nozzle rotator 201 is also shown, which may be, by way of example, a servo-mechanism, an electric motor, or a hydraulic motor. We generally prefer hydraulic motors for the various rotators and drivers disclosed herein. Nozzle rotator 201 spins the nozzle or nozzle tip as disclosed in more detail below.

Figure 3:
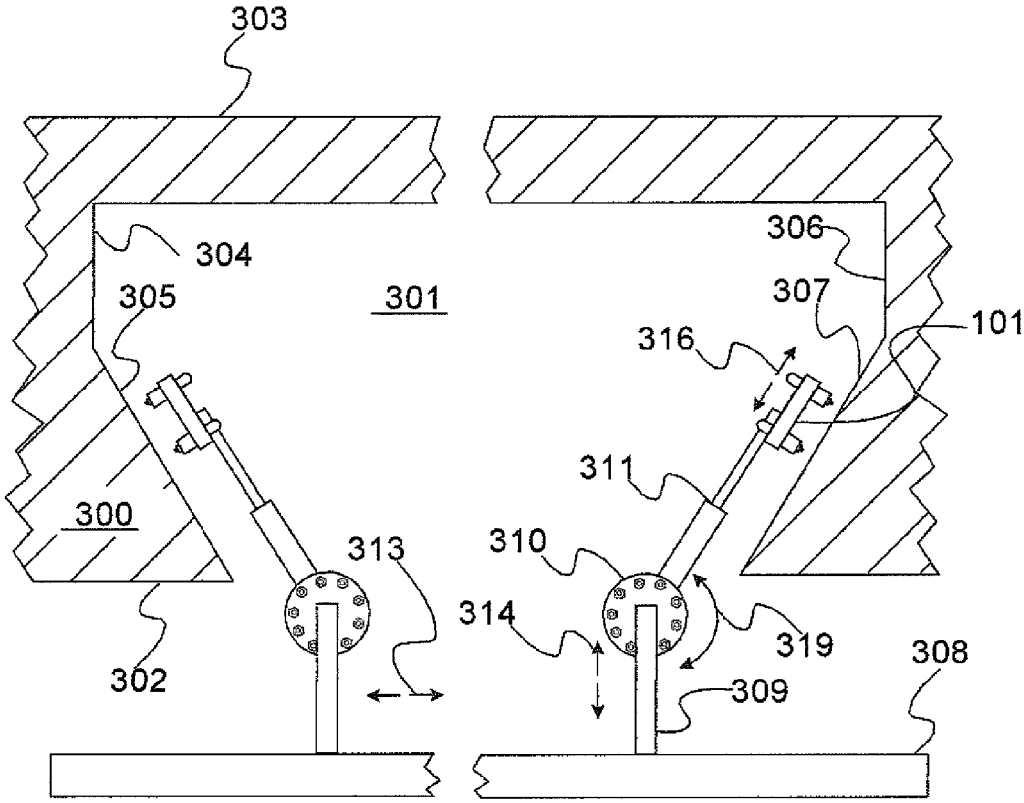
FIG. 3 shows a top elevation of the invention being used to produce an opening with sides having multiple facets.

FIG. 3 is a simplified diagram showing generally how the invention is used to create a complex faceted-opening in a structure. The view is looking down on a wall 300 in which an opening 301 is being cut using the facet-cutting apparatus and method of the invention. The initial work-face is shown at 302, which may be conveniently referred to as the "exterior surface" of the wall. The opening is proceeding from the bottom of the figure upwards. The objective is normally to extend the opening completely through the wall and through the opposing surface 303, which may be conveniently referred to as the "interior surface" of the wall. "Exterior" and "interior" are terms of convenience used with respect to FIG. 3 and are not limiting in any sense.

The opening being produced in FIG. 3 is a faceted opening. For instance, the sides of the opening have two "standard" squared surfaces 304 and 306, and two facets 305 and 307 that must be produced with considerable precision, perhaps to accommodate machinery that must be angled in order to be removed from the interior of the structure.

FIG. 3 may be interpreted either as a single machine that is movable back and forth from one end of the opening to the other, as indicated by arrow-pair 313, or as two separate machines operating independently and simultaneously. Our preference is to use a single machine and move it back and forth along the work-face as described below.

Component 308 represents a part of the carrier or frame to which the invention is attached. In the preferred embodiment, component 308 is a movable lift-beam that is attached to a fixed, stationary frame. The lift-beam is disposed in a generally horizontal orientation across the work-face. The lift-beam carries the facet-cutter and can be raised and lowered along the work-face, for instance, in the manner described in our US patent application, publication number 2006/0087168. Thus, in FIG. 3 lift-beam 308 would be moving in and out of the plane of the page. However, this is but one of may possible embodiments and component 308 is representative of a number of different ways to hold or carry the facet cutter that will be obvious to those of skill in the art after reading this disclosure.

Extending outward from the lift-beam toward the wall is a support member 309. The support member travels back and forth along the lift-beam in a reversible rectilinear motion, as shown by arrow-pair 313. This motion is produced by means of a support member driver (not shown in FIG. 3) such as a sprocket/chain, rack and pinion, hydraulic or electric motor, or the like.

Rotatably attached to the support member is a yaw assembly, which includes yaw plate 310. By means of a yaw plate rotation mechanism or a yaw plate rotator (not shown in FIG. 3), the yaw plate rotates about a yaw axis that is perpendicular to the longitudinal axis of support member 309 and also perpendicular to the longitudinal of arm 311. This yawing is indicated by the double-headed arrow 319.

Optionally, the yaw assembly can also move rectilinearly along the support member; i.e., toward or away from the wall 302 and into and out of the opening 301, as indicated by the arrow-pair 314. This motion may be effectuated by a yaw assembly driver (not shown in FIG. 3) moving the yaw assembly along the support member. If the facet cutter is carried by a movable boom, for instance on a cherry-picker type device, a separate yaw assembly driver may not be necessary since the boom can be used to move the yaw assembly in and out of the opening, effectively making the boom and it's control elements the yaw assembly driver.

Attached to the yaw plate is an arm assembly, which arm assembly holds the nozzle head 101. The arm assembly includes an arm 311. Optionally, the arm is able to extend and retract the nozzle head rectilinearly along or parallel to the longitudinal axis of the arm, as shown by arrow-pair 316. This movement may be effectuated by an arm driver (not shown in FIG. 3) that causes the arm to extend and retract, thereby moving the nozzle head rectilinearly to-and-fro along an axis that is coincident with or parallel to the longitudinal axis of the arm. The arm assembly may also include a nozzle head rotation mechanism or rotator (not shown in FIG. 3) that causes the nozzle head 101 to roll about the longitudinal axis of the arm. The nozzle head is attached at or near the distal end 311*b* of the arm, and the proximal end 311*b* of the arm is attached to the yaw assembly.

Figure 4A:
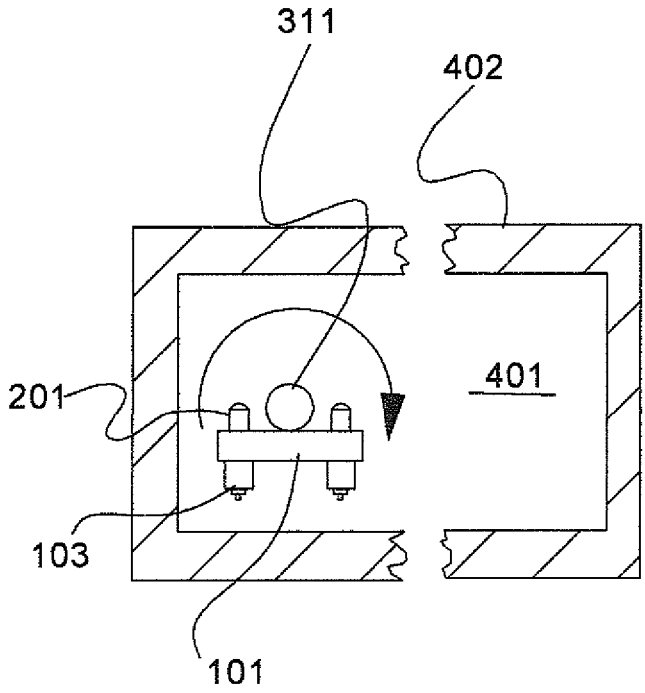
FIGS. 4A and 4B illustrate the ability of the nozzle head to execute a roll in order to accommodate differing facet orientations.
Figure 4B:
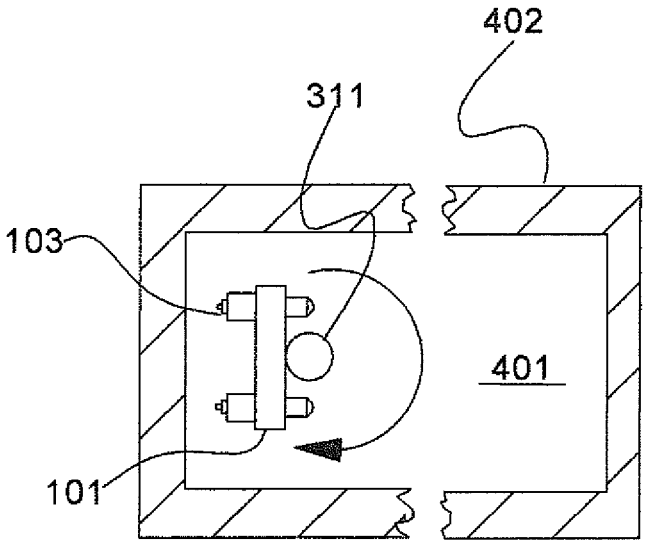

FIGS. 4A-B show the rolling of the nozzle head 101 about the arm 311. In this example, an opening 401 is being cut in wall 402. The view is looking into the opening through a cross-section taken through the wall. Nozzle head 101 is carried on arm 311, as described above. Nozzle 103 and nozzle rotator 201 are indicated in FIG. 4A.

A nozzle head rotator (not shown in FIG. 4) causes the entire nozzle head to roll about the axis of the arm so that the same nozzle head can be positioned to attack each of the sides of the opening. Two of such positions are shown FIGS. 4A and 4B.

These elements and assemblies provide the following functions and capabilities: 1) The yaw assembly moves toward and away from the work-face and into and out of the opening by the rectilinear movement along the support member (arrow-pair 314). 2) The nozzle head moves along and parallel to the plane of the facet by means of the extension/retraction of the arm (arrow-pair 316). 3) The arm assembly, and nozzle head yaw as a unit (arrow 319) so that the nozzle head can be positioned to accommodate any facet angle. 4) The nozzle head can roll about the longitudinal axis of the arm (FIGS. 4A, 4B) in order to attack any of the interior surfaces of the opening. By virtue of the ability of the nozzle head to yaw, roll, and extend/retract, as described above, facets of varying angles and descriptions can be cut into the sides of an opening with just this single apparatus. Consequently, it is not necessary to disassemble/reassemble complex hydro-demolition equipment or to pre-fabricate hydro-demolition parts to cut openings that have multiple, complex facets.

Figure 5:
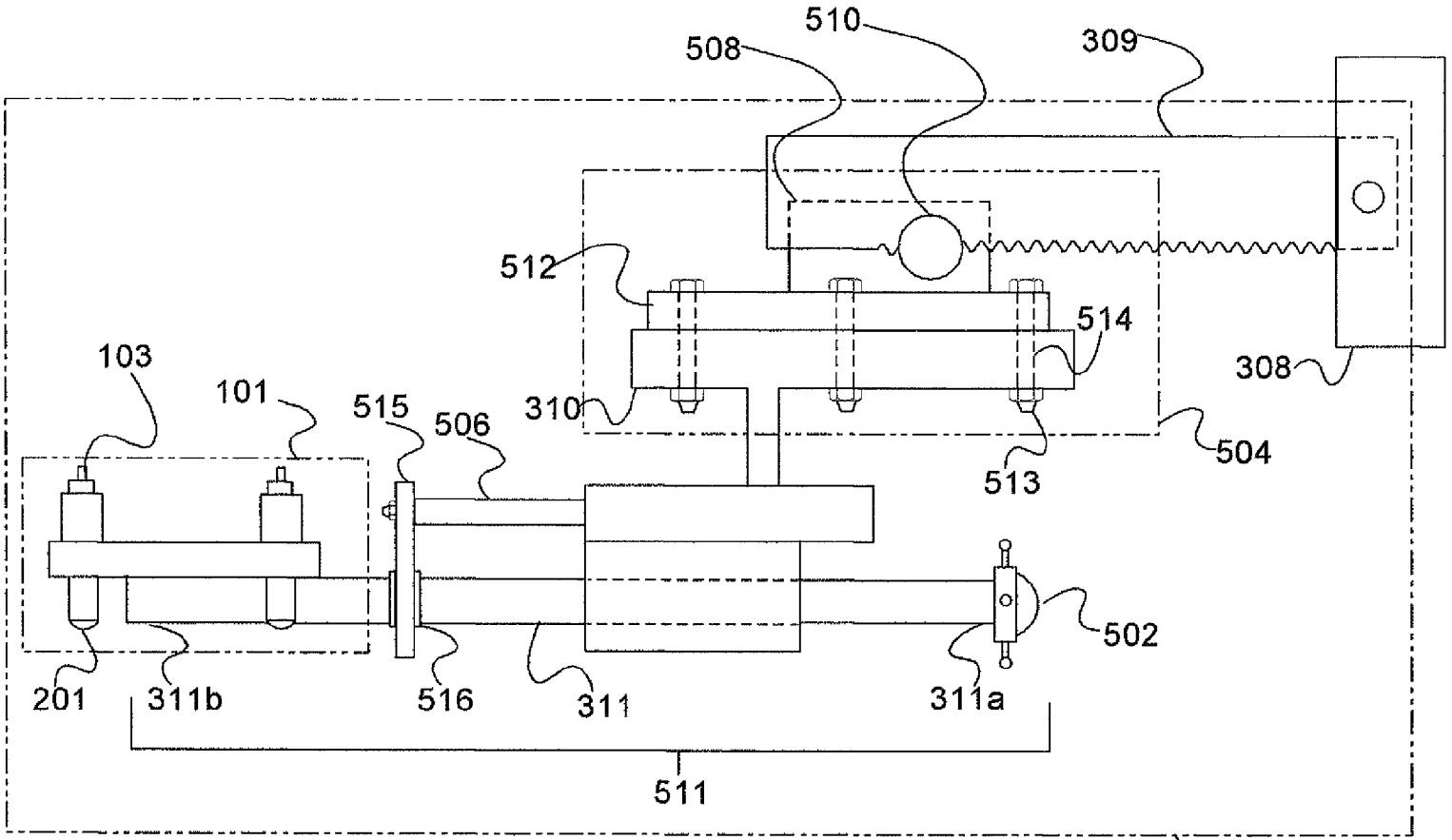
FIG. 5 is a side elevation of the invention showing the major elements grouped as component-groups.

FIG. 5 is a side elevation showing the above embodiment of the invention and its components and sub-components in more detail. The phantom-boxes and bracket of the figure enclose various component-groupings arbitrarily arranged for didactic purposes as follows: phantom box 501 encloses the facet-cutter of the invention; phantom box 504 encloses the yaw assembly; brace 511 encloses the arm assembly; and, phantom box 101 encloses the nozzle head.

Figure 6:
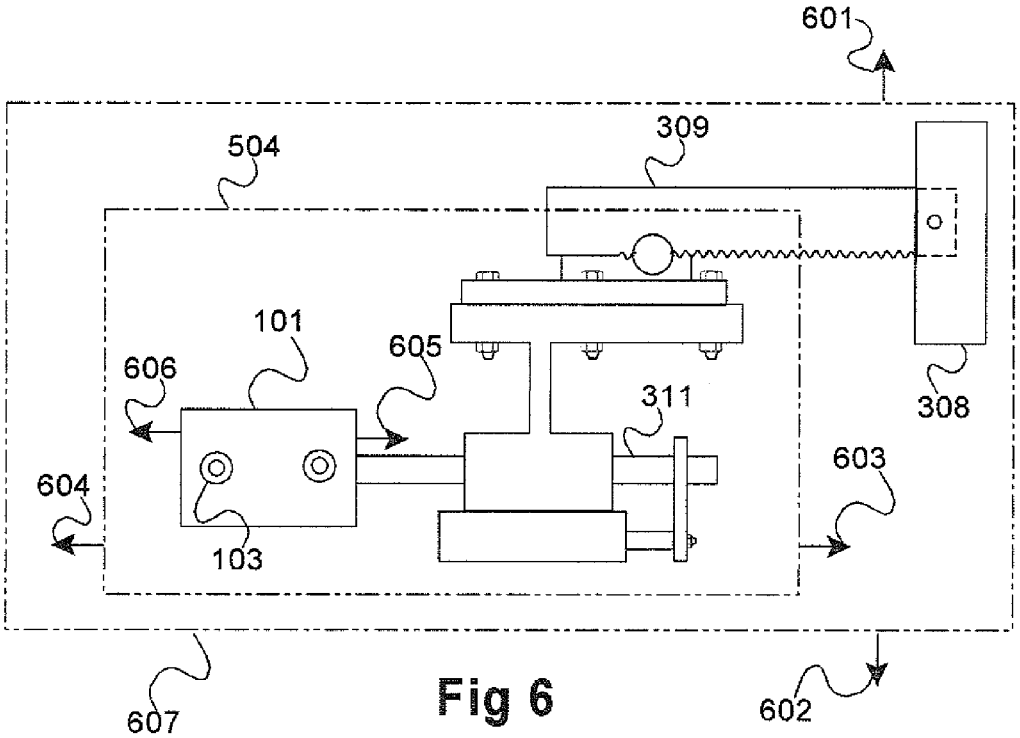
FIG. 6 is a side elevation of the invention showing rectilinear motions of the various components.
Figure 7:
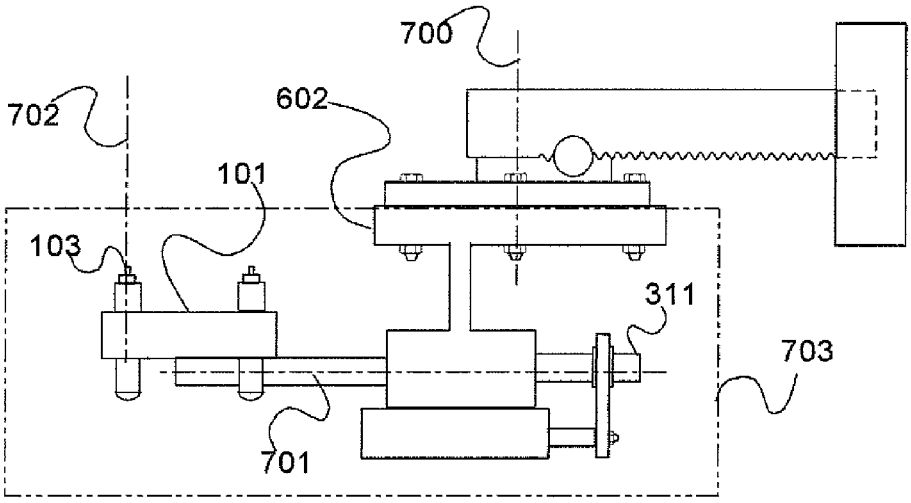
FIG. 7 is a side elevation of the invention showing axial motions of the various components.

Nozzle head 101 shown in FIG. 5 is as previously disclosed, comprising one or more nozzles 103 and one or more nozzle rotators 201 mounted on a nozzle plate 102. FIGS. 5-7 show two nozzles and two rotators, but the scope of the invention is not restricted to the number or arrangement of nozzles and rotators.

Yaw assembly 504 comprises a yaw assembly rotator, which is a mechanism and structure for yawing the yaw assembly. In one embodiment, the yaw assembly rotator includes yaw plate 310, mounting plate 512, holes 514 in the yaw plate and mounting plate, and through-bolts 513. In this embodiment, the yawing is accomplished by manually rotating the yaw plate with respect to the mounting plate and matching the holes in the yaw plate and mounting plate such that the holes receive through-bolts 513 when the proper angle is obtained. The bolts are secured by nuts. A motorized yaw assembly rotator is within the scope of the invention and is easily provided by a rotator mechanism of any type currently known in the art. For instance, a yaw assembly rotator may comprise a spur gear attached to the yaw plate and driven by a pinion that is turned by a motor. However, the present embodiment, the one we presently consider to be the best mode, is to adjust the yaw angle manually.

The yaw assembly 504 includes a mechanism for connecting to the support member 309. This mechanism may be simply a weld, or bolts, or other static connector, in which case the yaw assembly is fixed at a given position on the support member. Alternatively, the connecting mechanism may allow rectilinear movement of the yaw assembly along the support member. For instance, a carrier block 508 may be provided as part of a rack and pinion mechanism that is powered by a carrier block driver 510 so that the yaw assembly can move along an axis that is coincident with or parallel to the axis of the support member, thereby moving both the yaw assembly 504 and the nozzle head 101 rectilinearly. We prefer a yaw assembly that is moveable along the support member as shown in FIG. 5. However, if the support member is itself a moveable boom or is connected to a moveable element that allows the yaw assembly to be moved into and out of the opening, then the simpler, static connecting mechanism may be preferred.

Arm assembly 511 includes arm 311, which is shown in FIG. 5 as being reversibly extendible. A nozzle head driver such as hydraulic ram 506 reversibly extends and retracts the arm so that the nozzles may pass back and forth in the plane of the facet being cut. The ram may connect to the arm by means of a plate or fork 515 and collars or bearings 516, which permit rotation of the arm and, hence, rolling of nozzle head 101. The nozzle head driver may be of a variety of types of motors or servo-mechanisms, as previously mentioned.

The arm assembly may also include a nozzle head rotator 502 that rolls the nozzle head about the axis of the arm 311, as was illustrated in FIGS. 4A and 4B.

FIG. 6 illustrates the rectilinear movements of the various component-groups comprising the present embodiment of the invention. Four types of rectilinear motion are required to fully exploit the invention. First, the facet cutter as a whole and the lift-beam 308 move as a unit 607 vertically, up and down the work-face as indicated by arrow pair 601/602. Although this motion may not be necessary in some applications, normally it is necessary to position and repeatedly reposition the nozzle at the proper height on a vertical work-face, or at the proper position over a horizontal work-face. The lift-beam 308 is movably mounted on a frame and extends across the work-face. The lift-beam is raised and lowered on the frame, preferably in a manner previously disclosed in our U.S. patent application, publication number 2006/0087168, and as shown in FIG. 9.

A second type of rectilinear motion is to move the facet cutter horizontally back and forth across the work-face. This motion is not explicitly shown in FIG. 6 because the motion would be in and out of the page. This motion is preferably effectuated by having support member 309 moveable along the length of the lift-beam 308 in a manner previously disclosed in our U.S. patent application, publication number 2006/0087168, and as shown in FIG. 9.

A third type of rectilinear motion is to move the yaw assembly along an axis coincident with or parallel to the axis of the support member 309, which is to say, toward and away from the work-face, or into and out of the opening. Preferably, the yaw assembly, arm assembly, and nozzle head move as a unit 504. This motion, which is indicated by arrow set 604/603, is effectuated by the yaw assembly driver discussed above.

A fourth type of rectilinear motion is to move nozzle head 101 parallel to the plane of the facet being cut, along a path coincident with or parallel to the axis of arm 311. This motion is indicated by arrow set 605/606. The rectilinear motion is effectuated by extension and retraction of arm 311 to which the nozzle head 101 is attached. The nozzle head driver produces this movement, as described above.

FIG. 7 illustrates the axial motions of the various component-groups and elements of the invention, which axial motions can most conveniently be described with reference to three axes of rotation: yaw axis 700, roll axis 701, and nozzle rotation axis 702.

A first axial motion of interest is yawing of the yaw plate, arm assembly, and nozzle head as a unit 703 about yaw axis 700 to establish a desired yaw angle. The yaw angle may be thought of as the angle subtended by the axes of support member 309 and arm 311. (See FIG. 3.) This angle is adjusted by the yaw assembly rotator mechanism, such as yaw plate 602 as described above. This yawing is what orients the nozzle head to the desired angle of the facet being cut, as shown in FIG. 3.

A second axial motion is the rolling of the nozzle head 101 about a roll axis 701 that is substantially coincident with or parallel to the longitudinal axis of the arm 311. This rolling is produced by a nozzle head rotator and provides a 360 degree range of motion for attacking the top, sides, and bottom of an opening, as shown in FIG. 4 and described above. The structure and operation of the nozzle head rotator is described above.

A third axial motion is the rotation of the individual nozzles about a nozzle rotation axis 702. This nozzle rotation is achieved by means of the nozzle rotator described above. The nozzle rotation axis and the nozzle axis are not necessarily the same. The nozzle axis may be angled with respect to the nozzle rotation axis so that the tip of the nozzle rotates about, but is not coincident with, the nozzle rotation axis. This off-set rotation increases the area each nozzle is capable of cutting, as disclosed in our US patent application, publication number 2006/0087168.

2. Method of Using the Invention

Figure 10:
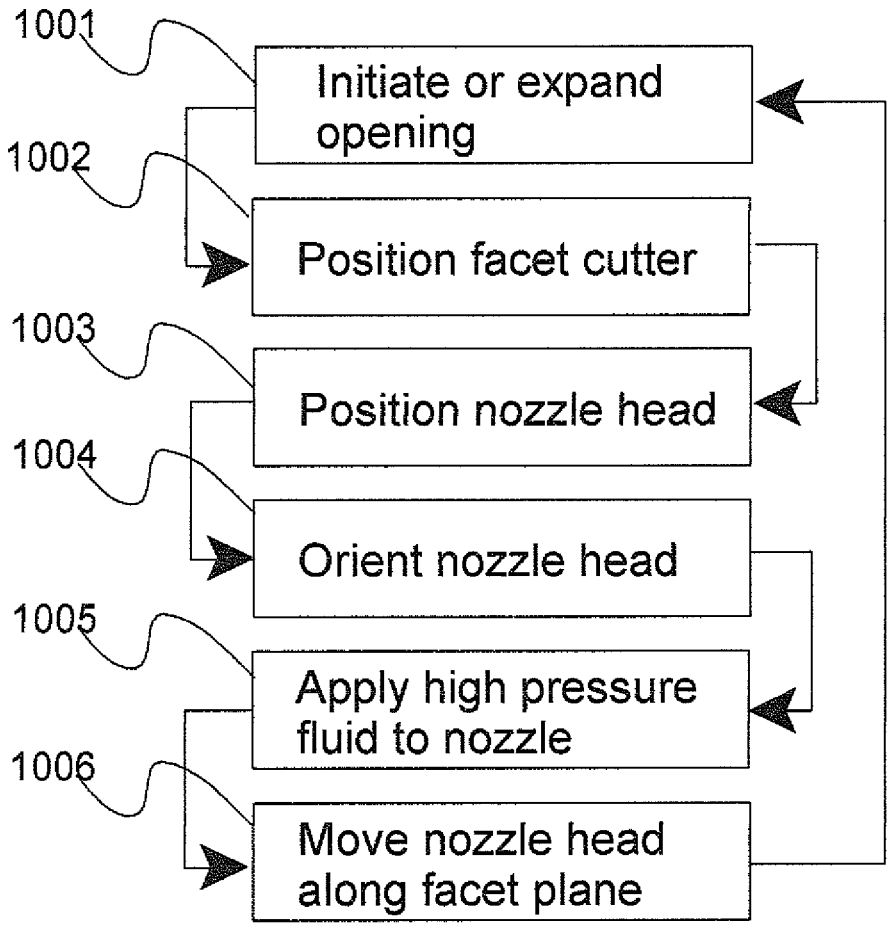
FIG. 10 is a flow chart of one preferred embodiment of the method of the invention.

The method of using the facet cutter 802 system of the invention is disclosed by reference to FIGS. 8-10. FIG. 8 shows a side elevation of the invention in the process of cutting a facet and FIG. 9 is a perspective view of one preferred embodiment of the invention mounted on a frame. A preferred series of steps for using the facet cutter of the invention is summarized in FIG. 10. The steps may be performed in whatever order is most efficient and effective for a given job. Some steps may not be required and others may be added according to the nature and requirements of the job.

A remote control device 810 comprising controls for controlling the various rotators and drivers is provided and located substantially away from the opening. By use of this control device some or all of the motions described below can be executed by the operator manipulating controls of the control device. Using the control device the operator can control at least one of: 1) the movement, 2) the position, and 3) the orientation of the nozzle head. This remote control device is a very valuable feature of the system because it allows the worker to safely control the complex operation of cutting a facet without being exposed to flying debris, dust, and fluid.

A carrier or frame 804, 900 is set up adjacent the wall 800. In many instances, the opening to be cut is many feet off of the ground; consequently, a platform 813 is provided to support the hydro-demolition equipment. As noted above, we prefer a frame that has a lift-beam disposed horizontally across the face of the wall. This is most clearly shown as element 905 in FIG. 9. In the case of curved structural surfaces such as nuclear reactors, it is often advantageous to provide a curved lift-beam 905 as shown in FIG. 9, where the curvature of the beam approximates the curvature of the structural surface. This can minimize the need to re-position the frame from time to time when working on such curved surfaces. FIG. 9 also shows the nozzle head 904 connected to the arm 903, which is connected by the yaw assembly 902 to the support member 901. Lift-beam 905 is raised and lowered by means of a lift-beam driver 906. Various types of rectilinear and axial motions described above are indicated by the arrows. In order to avoid cluttering the figure, the drivers and rotators discussed above have been removed from FIG. 9.

Because of the cutting process requires a large number of hydraulic hoses, electrical cables, and high pressure hoses, we prefer to use a hose and cable retainer 805 to help keep hoses and cables out of the way during the cutting process. This retainer may be attached to the frame as shown, or it may be suspended from the upper frame.

FIG. 8 shows a high pressure hose 806 connected to a nozzle of nozzle head 803. We prefer to use one high pressure hose per nozzle in order to provide as much control over the process as possible. The high pressure hose connects the nozzle to a source of high pressure fluid, which source is represented in the figure as tank 811 and pump 812.

Only a single representative control line 809 of many control lines is shown in the figure. These lines are used to control the various rotators and drivers. Control line 809, for example, is a hydraulic hose by which the nozzle head driver or nozzle head rotator are powered and controlled. Control lines could also be electrical where electrical motors serve as drivers or rotators. It is also entirely within the scope of the invention to employ wireless controls using wireless technology well known in the art of remote control.

It is often necessary to first initiate 1001 an opening 801 in the structural surface 800 using standard hydro-demolition equipment. As is amply disclosed in the art, existing hydro-demolition nozzles are configurable to move back and forth and up and down across the structural surface in order to cut a squared opening, which is to say, an opening with sides that are essentially normal to the surface of the wall. Generally, the initial squared opening is cut or at least begun prior to cutting the facets. Although such standard nozzle heads cannot be used to cut facets, they are very efficient at cutting openings with squared sides.

After the initial square opening has been completed or cut to a sufficient depth, the standard cutting apparatus is removed from the support frame. Facet cutter 802 is mounted on the frame in place of the standard cutting nozzles and positioned 1002 adjacent the opening. Next, in order to position 1003 the nozzle head adjacent a side of the opening that is to be faceted, the nozzle head is moved into the opening by extending the arm 903. Initially this rectilinear motion is preferably along an axis that is substantially perpendicular to the plane of the wall. In embodiments of the invention employing a fixed support member 901, the axis of this rectilinear motion will be along or parallel to the longitudinal axis of the support member.

The nozzle head is oriented 1004 such that the axes of the nozzles are substantially perpendicular to the desired plane of the first facet to be cut. This may require at least one of two axial motions: yawing about yaw axis 700 and rolling about roll axis 701.

As noted above, in our preferred embodiment, the yaw angle is set manually by yawing the arm 311 and nozzle head 101 about the yaw axis 700; however, this, and all axial and rectilinear motions, can be effectuated remotely by means of mechanical rotators and drivers controlled by the control device 810.

Once the nozzle head is in position and oriented properly, high-pressure fluid is applied 1005 to the nozzles by means of high-pressure hoses connecting the nozzles to a high-pressure source of the fluid such as a high pressure pump 812 and tank 811 arrangement. Delivery of the high pressure fluid to the nozzles is preferably also controlled by the control device 810.

A first facet is cut by emitting the high pressure fluid from the nozzles so that a jet of high-pressure fluid is directed against the opening side while moving the nozzle head rectilinearly in a plane that is substantially parallel to the desired plane of the face of the first facet 1006. This can be accomplished by extending and retracting arm 903 using the control device 810 to control nozzle head driver 506. Vertical adjustments along the face of the facet may be made by raising and lowering the lift-beam 905 of the frame 8041900 by activating lift motor 906. This process is continued until the first facet is cut to the desired size, shape, and depth.

If additional facets are required, optionally, the facet cutter is removed from the frame and the opening is expanded 1001 as required by using the standard cutting gear. Then the facet cutter is once again mounted on the frame, and the position and orientation of the nozzle head are re-adjusted 1002-1004 for cutting a second facet. Of course, in many situations it will not be necessary to repeatedly swap out facet cutter with the standard nozzle assembly if, for instance, the initial opening can be completed before facet-cutting begins. Preferably, the high-pressure fluid is turned off until the starting position and orientation of the nozzle head have been adjusted. Once the nozzle head is in position and oriented for the second facet, high-pressure fluid is applied 1005 to the nozzles, the nozzles emit the high-pressure fluid against the wall, and the second facet is cut in a manner similar to the way the first facet was cut. This process is repeated until all of the desired facets have been cut.

3. Summary

As indicated above, this invention provides many advantages to prior art hydro-demolition devices of the type used to cut openings in structural surfaces. A primary advantage is that a plurality of opening-facets can be cut by a single piece of equipment without the need for custom equipment and without repeatedly disassembling and re-assembling the cutting equipment. Another important advance in the art is having this complex process controlled remotely, thereby maximizing worker safety.

Many of the most important elements, steps, and limitations of the invention can be summarized by way of the following enumerated statements.

Statement 1: The invention includes a hydro-demolition facet cutter 802 for cutting facets 305, 307 in a side of an opening 301 in a structural surface 300, wherein the hydro-demolition facet cutter comprises: (a) a support member 309, wherein the support member forms a part of or is connected to a carrier or frame 804, 900; (b) a yaw assembly 310 connected to the support member; (c) an arm 311 having a proximal end 311*a* and a distal end 311*b*, wherein the proximal end of the arm is connected to the yaw assembly; (d) a nozzle head 101 connected to the distal end of the arm, wherein the nozzle head comprises at least one nozzle 103, wherein the yaw assembly allows the arm and the nozzle head to yaw as a unit about a yaw axis 700; (e) one or more drivers 506, 510, wherein said one or more drivers move the nozzle head rectilinearly; and, (f) a control device 810, wherein the control device is used remotely to control at least one of movement, position, and orientation of the nozzle head.

Statement 2: The invention includes the hydro-demolition facet cutter of claim 1 wherein at least one of said drivers 506 moves the nozzle head rectilinearly along an axis that is coincident with or substantially parallel to a longitudinal axis of said arm.

Statement 3: The invention includes the hydro-demolition facet cutter of claim 1 wherein at least one of said drivers 510 moves said yaw assembly rectilinearly along an axis that is coincident with or parallel to a longitudinal axis of said support member.

Statement 4: The invention includes the hydro-demolition facet cutter of Statement 3 wherein said control device 810 is wireless.

Statement 5: The invention includes the hydro-demolition facet cutter of Statement 1 further comprising a rotator 310/512, 502 that moves or allows movement of the nozzle head in an axial motion.

Statement 6: The invention includes the hydro-demolition facet cutter of Statement 8 wherein the axial motion is rolling of the nozzle head 101 about a roll axis 701.

Statement 7: The invention includes the hydro-demolition facet cutter of Statement 5 wherein the axial motion is the yawing of the nozzle head and arm about the yaw axis 700.

Statement 8: The invention includes a method of using the facet cutter 802 as disclosed in at least one of Statements 1 through 7, inclusive, to cut a facet in the side of an opening in a structural surface, the method comprising the steps of: (a) positioning the facet cutter 802 adjacent the opening; (b) positioning the nozzle head 101 adjacent the side; (c) orienting the nozzle head so that the axis of the nozzle 103 is substantially perpendicular to the desired plane of the face of the facet; (d) applying high-pressure fluid to the nozzle; and, (e) moving the nozzle head along the desired plane of the face of the facet, Statement 9: The invention includes the method of Statement 8 wherein at least one of Steps (a) through (e), inclusive, is performed remotely by manipulating controls of the control device 810.

From the foregoing description, the novelty, utility, and means of using our invention will be readily apprehended. It is to be understood that the scope of our invention is not limited to the embodiments disclosed above but encompasses any and all embodiments lying within the scope of the foregoing disclosures, including the figures, and the following claims.

I claim:

1. A hydro-demolition facet cutter (802) for cutting facets in a side of an opening of a structural surface, wherein said hydro-demolition facet cutter comprises:

a. a support member (309), wherein said support member forms a part of or is connected to a carrier or frame;

b. a yaw assembly (310) connected to said support member;

c. an arm (311) having a proximal end (311*a*) and a distal end (311*b*), wherein said proximal end of said arm is connected to said yaw assembly;

d. a nozzle head (101) connected to said distal end of said arm, wherein said nozzle head comprises at least one nozzle (103), wherein said yaw assembly allows said arm and said nozzle head to yaw as a unit about a yaw axis (700);

e. one or more drivers (506, 510), wherein said one or more drivers move said nozzle head rectilinearly; and, f. a control device (810), wherein said control device is used remotely to control at least one of movement, position, and orientation of said nozzle head.

2. The hydro-demolition facet cutter of claim 1 wherein at least one of said drivers (506) moves said nozzle head rectilinearly along an axis that is coincident with or substantially parallel to a longitudinal axis of said arm.

3. The hydro-demolition facet cutter of claim 1 wherein at least one of said drivers (510) moves said yaw assembly rectilinearly along an axis that is coincident with or parallel to a longitudinal axis of said support member.

4. The hydro-demolition facet cutter of claim 1 wherein said control device is wireless.

5. The hydro-demolition facet cutter of claim 1 further comprising a rotator mechanism (310/512, 502) that moves or allows movement of said nozzle head in an axial motion.

6. The hydro-demolition facet cutter of claim 5 wherein the axial motion is rolling of said nozzle head about a roll axis (701).

7. The hydro-demolition facet cutter of claim 5 wherein the axial motion is yawing of the nozzle head and arm about the yaw axis (700).

8. A method of using the facet cutter (802) of at least one of claims 1 through 7, inclusive, to cut a facet in the side of an opening in a structural surface, said method comprising the steps of:

(a) positioning the facet cutter adjacent the opening;

(b) positioning the nozzle head (101) adjacent the side;

(c) orienting the nozzle head so that the axis of the nozzle (103) is substantially perpendicular to the desired plane of the face of the facet;

(d) applying high-pressure fluid to the nozzle; and, (e) moving the nozzle head along the desired plane of the face of the facet.

9. The method of claim 8 wherein at least one of Steps (a) through (e), inclusive, is performed remotely by manipulating controls of the control device (810).

* * * * *